US008841528B2

(12) United States Patent
Hoshino

(10) Patent No.: US 8,841,528 B2
(45) Date of Patent: Sep. 23, 2014

(54) KEYBOARD DEVICE

(71) Applicant: Casio Computer Co., Ltd., Tokyo (JP)

(72) Inventor: Akihisa Hoshino, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/894,230

(22) Filed: May 14, 2013

(65) Prior Publication Data

US 2013/0305901 A1 Nov. 21, 2013

(30) Foreign Application Priority Data

May 17, 2012 (JP) ..... 2012-112992

(51) Int. Cl.
*G10C 3/02* (2006.01)
*G10C 3/12* (2006.01)
*G10H 1/32* (2006.01)

(52) U.S. Cl.
CPC ... *G10C 3/12* (2013.01); *G10H 1/32* (2013.01)
USPC ..... 84/179; 84/423 R

(58) Field of Classification Search
USPC ..... 84/179, 423 R
See application file for complete search history.

(56) References Cited

U.S. PATENT DOCUMENTS

| | | | | |
|---|---|---|---|---|
| 5,973,241 | A * | 10/1999 | Tetsumura | 84/179 |
| 6,673,991 | B2 * | 1/2004 | Hara | 84/179 |
| 7,495,158 | B2 * | 2/2009 | Nagatsuma | 84/179 |
| 7,507,883 | B2 * | 3/2009 | Ooi | 84/178 |
| 7,642,437 | B2 * | 1/2010 | Terada | 84/179 |
| 8,193,438 | B2 * | 6/2012 | Hoshino | 84/644 |
| 8,330,027 | B2 * | 12/2012 | Kono | 84/179 |
| 2013/0305899 | A1 * | 11/2013 | Nagatsuma et al. | 84/423 R |
| 2013/0305900 | A1 * | 11/2013 | Nagatsuma | 84/423 R |
| 2013/0305901 | A1 * | 11/2013 | Hoshino | 84/436 |

FOREIGN PATENT DOCUMENTS

| | | | |
|---|---|---|---|
| JP | 2009-145711 A | | 7/2009 |
| JP | 2010224134 A | * | 10/2010 |
| JP | 2010224139 A | * | 10/2010 |
| JP | 2013242385 A | * | 12/2013 |

* cited by examiner

*Primary Examiner* — Robert W Horn
(74) *Attorney, Agent, or Firm* — Holtz Holtz Goodman & Chick PC

(57) ABSTRACT

A keyboard device of the present invention includes a front guide shaft that is provided on the front portion of a front lid and projects toward sides of the front lid, a rear guide shaft that is provided on the front portion of a rear lid and projects toward sides of the rear lid, and a guide groove that guides the front guide shaft and the rear guide shaft in the front and back directions of a musical instrument case. The guide groove is provided with a guide recess where the rear guide shaft comes in so that the front lid and the rear lid are placed on the same plane when a keyboard lid is closed and covers a keyboard section.

7 Claims, 8 Drawing Sheets

KEYBOARD DEVICE

CROSS-REFERENCE TO RELATED APPLICATION

This application is based upon and claims the benefit of priority from the prior Japanese Patent Application No. 2012-112992, filed May 17, 2012, the entire contents of which are incorporated herein by reference.

BACKGROUND OF THE INVENTION

1. Field of the Invention

The present invention relates to a keyboard device for use in a keyboard musical instrument such as an electronic piano.

2. Description of the Related Art

A keyboard musical instrument is known which is structured such that a keyboard section provided in a musical instrument case is openably and closably covered by a keyboard lid having a front lid and a rear lid foldably coupled together with a coupling section, as described in Japanese Patent Application Laid-Open (Kokai) Publication No. 2009-145711.

An open and close device for the keyboard lid of this type of keyboard musical instrument includes a front guide shaft that is provided on the front portion of the front lid and projects toward sides of the front lid, a displacement mount section that is provided on the front portion of the rear lid and resiliently displaced in a vertical direction, a rear guide shaft that is mounted on the displacement mount section and projects toward sides of the rear lid, and a common guide groove that guides the front guide shaft and the rear guide shaft in a forward and rearward direction of the musical instrument case.

On the front portion of the common guide groove, a drooping portion is formed, drooping downward from above the front side of the keyboard section. Immediately before the keyboard lid is completely closed, the front guide shaft is guided by the drooping portion. As a result, the front portion of the keyboard section is covered and hidden.

In this open and close device of the keyboard lid, the front guide shaft and the rear guide shaft are inserted into the common guide groove to be guided. Thus, when the keyboard lid is opened or closed, the front guide shaft and the rear guide shaft are both guided by the common guide groove. Accordingly, both of the guide shafts can be moved by using one guide groove.

Immediately before the keyboard lid is closed, the front guide shaft is guided by the drooping portion of the common guide groove to make a drooping movement.

Accordingly, the rear guide shaft also similarly makes a drooping movement. However, the common guide groove guiding the rear guide shaft does not have a drooping shape for letting the rear guide shaft to make a drooping movement. Therefore, a structure for absorbing a drooping movement amount of the rear guide shaft is required.

For this purpose, in the structure disclosed in Japanese Patent Application Laid-Open (Kokai) Publication No. 2009-145711, the displacement mount section for absorbing the drooping movement amount is provided to let the rear guide shaft to make a drooping movement. Immediately before the keyboard lid is closed, the displacement mount section is displaced in the vertical direction by the weight of the keyboard lid to cause the front lid and the rear lid to be placed on a same plane.

However, since this open and close device of the keyboard lid is structured so that the front guide shaft and the rear guide shaft are inserted into the common guide groove to be guided. If the displacement mount section for displacing the rear guide shaft of the rear lid in the vertical direction with respect to the rear lid is not provided, the keyboard lid is bent by the rear portion of the front lid and the front portion of the rear lid being lifted and therefore the front lid and the rear lid cannot be placed on the same plane when the keyboard section is covered and closed by the front lid and the rear lid.

Therefore, there is a problem in this open and close device of the keyboard lid in that the structure is intricate and complex and, when the front guide shaft and the rear guide shaft are guided by the common guide groove, the rear lid is resiliently displaced by the displacement mount section in the vertical direction, whereby the open and close movements of the keyboard lid become unstable.

SUMMARY OF THE INVENTION

An object of the present invention is to provide a keyboard device in which a keyboard lid can be stably and smoothly opened or closed with a simple structure. Specifically, an object of the present invention is to achieve a structure where a drooping movement amount of a rear guide shaft is stably absorbed which occurs when a front guide shaft makes a drooping movement by a drooping portion of a common guide groove.

In accordance with one aspect of the present invention, there is provided a keyboard device comprising: a keyboard section which is provided in a musical instrument case; a keyboard lid which is foldable by a front lid and a rear lid being coupled together by a coupling section so as to cover the keyboard section; a front guide shaft which is provided on front portion of the front lid and projects toward sides of the front lid; a rear guide shaft which is provided on front portion of the rear lid and projects toward sides of the rear lid; and a guide groove which guides the front guide shaft and the rear guide shaft in front and back directions of the musical instrument case, and is provided with a guide recess where the rear guide shaft comes in so that the front lid and the rear lid are placed on a same plane when the front lid and the rear lid are closed and cover the keyboard section.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 5A and FIG. 5B are side views of the guide groove taken along line B-B in FIG. 4, of which FIG. 5A is an enlarged sectional view showing a state where a front guide shaft of a front lid passes above a guide recess of the guide groove, and FIG. 5B is an enlarged sectional view showing a state where a rear guide shaft of a rear lid has come into the guide recess of the guide groove;

DETAILED DESCRIPTION OF THE PREFERRED EMBODIMENTS

With reference to FIG. 1 to FIG. 8, an embodiment in which the present invention has been applied to a keyboard musical instrument is described below.

Figure 1:
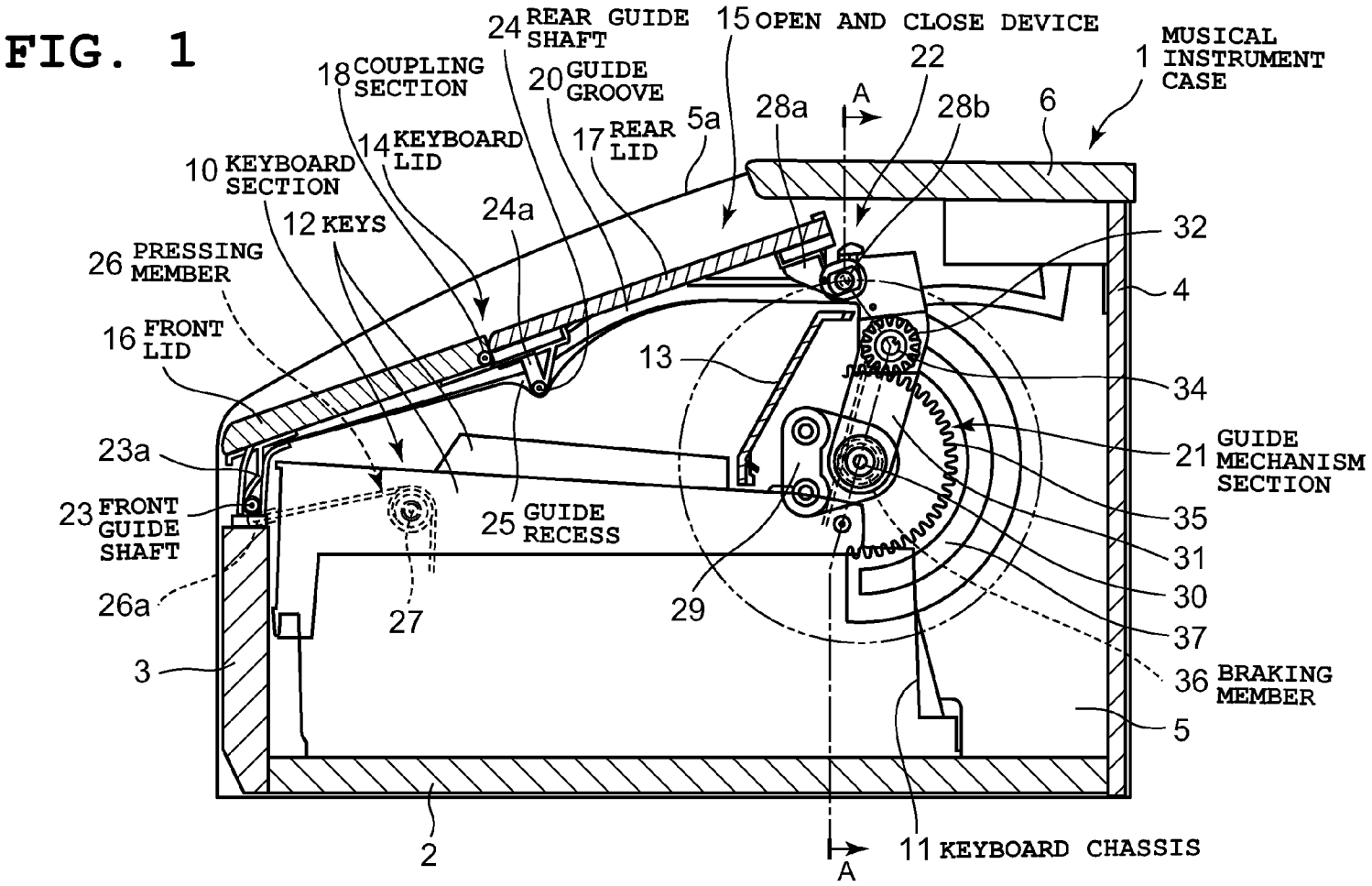
FIG. 1 is a sectional view of an embodiment in which the present invention has been applied to a keyboard musical instrument.
Figure 2:
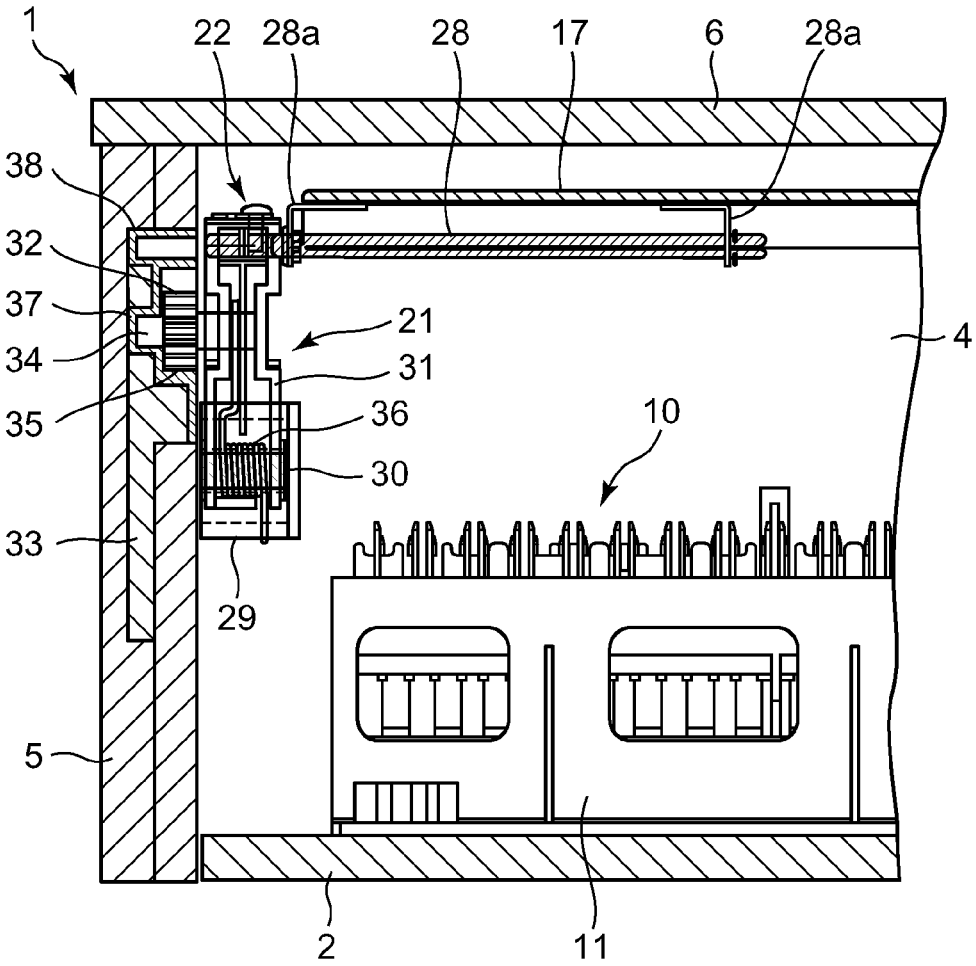
FIG. 2 is a sectional view of the keyboard musical instrument taken along line A-A in FIG. 1.
Figure 3:
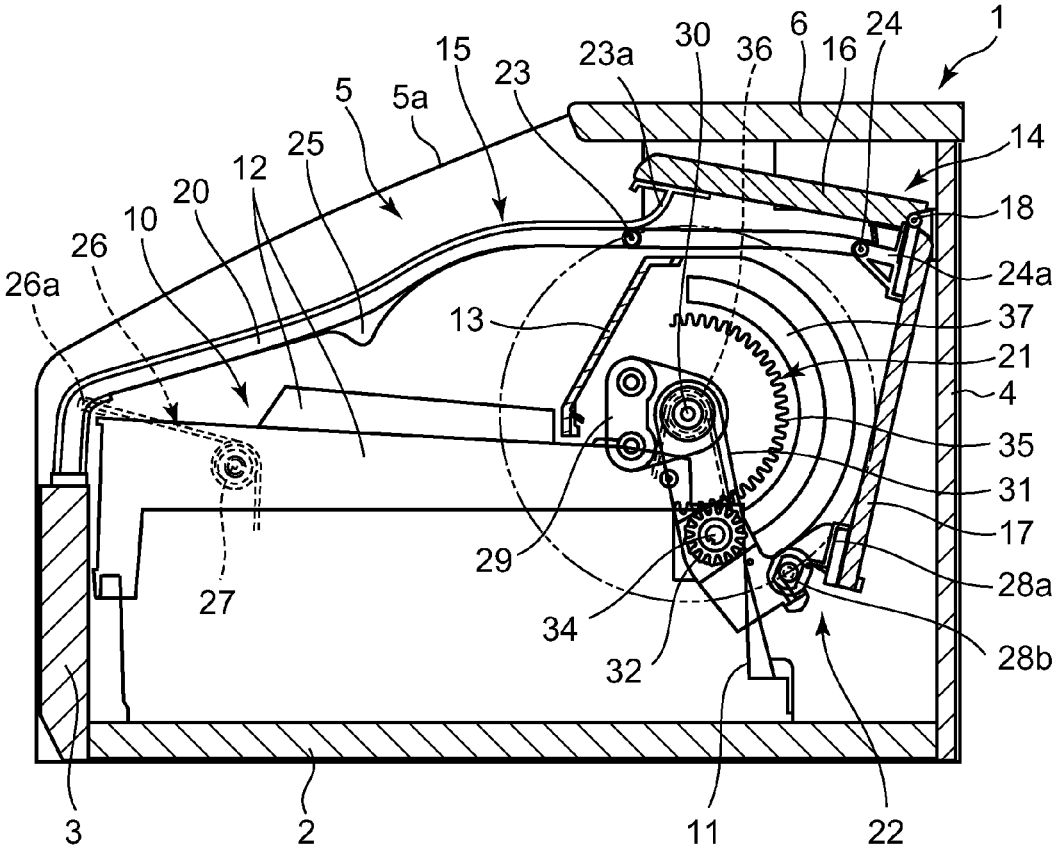
FIG. 3 is a sectional view of the keyboard musical instrument depicted in FIG. 1, in which a keyboard lid has been opened to cause a keyboard section to be exposed to the upper side of a musical instrument case.

As depicted in FIG. 1 to FIG. 3, the keyboard musical instrument includes a musical instrument case 1. The musical instrument 1 is formed substantially in an elongated box shape (elongated from the front to rear direction of the paper sheet in FIG. 1) with its upper front portion (upper left portion in FIG. 1) opened.

That is, as depicted in FIG. 1 to FIG. 3, the musical instrument case 1 includes a bottom plate 2, a front plate 3 provided upright at the front end (left end in FIG. 1) of the bottom plate 2, a rear plate 4 provided upright at the rear end (right end in FIG. 1), paired side plates 5 provided upright at the left and right sides of the bottom plate 2 (both sides in the front to rear direction of the paper sheet in FIG. 1), and a top plate 6 provided at the upper portion of the paired side plates 5 and the upper portion of the rear plate 4.

In this case, as depicted in FIG. 1 to FIG. 3, the front plate 3 is formed such that the height is substantially half of the height of the rear plate 4. The paired side plates 5 are each formed such that the front end is slightly higher than the front plate 3, the height from a substantially intermediate portion in the front to rear direction (left to right direction in FIG. 1) to the rear side is equal to the height of the rear plate 4, and the upper side portion located from the front end to the intermediate portion is tilted upward to the rear (to rise rightward in FIG. 1) as a tilted portion 5*a*.

As depicted in FIG. 1 to FIG. 3, the top plate 6 is provided so as to cover the upper portion of the paired side plate 5 located from the substantially intermediate portion to the rear side (right side in FIG. 1), and the upper portion of the rear plate 4. With this, the musical instrument case 1 is formed substantially in an elongated box shape with its upper portion on the front side (upper portion on the left side in FIG. 1) corresponding to the tilted portion 5*a* of each of the paired side plates 5 opened.

As depicted in FIG. 1 to FIG. 3, a keyboard section 10 is provided in the musical instrument case 1. The keyboard section 10 includes a keyboard chassis 11 placed on the bottom plate 2 of the musical instrument case 1 and a plurality of keys 12 arranged in parallel to each other in a manner to be rotatable in a vertical direction. As depicted in FIG. 3, the keyboard section 10 is structured so that the plurality of keys 12 are exposed upward from the front side of the musical instrument case 1 and the keys in this state are operated by being pushed. In the musical instrument case 1, a console panel 13 is provided obliquely from above the rear portion of the keyboard section 10 toward an area below the front portion of the top plate 6.

As depicted in FIG. 1 to FIG. 3, an open and close device 15 for a keyboard lid 14 is provided in the musical instrument case 1 to openably and closably cover the upper side of the keyboard section 10. In this case, the keyboard lid 14 has a front lid 16 and a rear lid 17, and is structured so as to be foldable by a coupling section 18 such as a hinge that couples the front lid 16 and the rear lid 17 together. In the keyboard lid 14, the length of the rear lid 17 in a front to rear direction (left to right direction in FIG. 1) is slightly longer than the length of the front lid 16 in the front to rear direction.

On the other hand, as depicted in FIG. 1 to FIG. 3, the open and close device 15 of the keyboard lid 14 includes a guide groove 20 that guides the keyboard lid 14 so that it opens or closes, and a guide mechanism section 21 that guides the rear end of the keyboard lid 14 in a vertical direction. In this case, a front guide shaft 23 is provided at the lower front end of the front lid 16 of the keyboard lid 14 and supported by a support section 23*a* so as to project toward the inner surface of each side plate 5. A rear guide shaft 24 is provided at the lower front end of the rear lid 17 and supported by a support section 24*a* so as to project toward the inner surface of each side plate 5.

Figure 4:
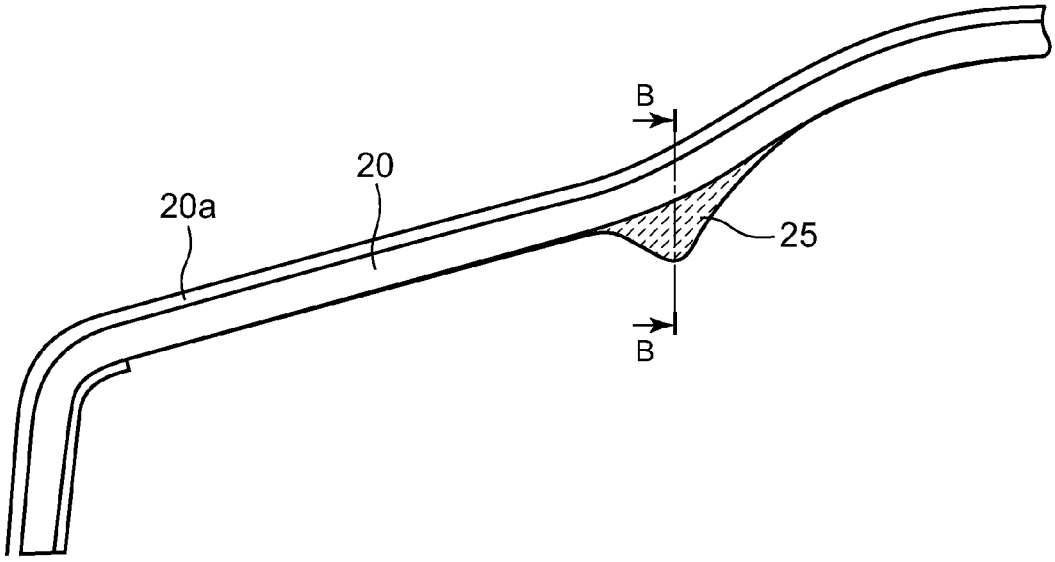
FIG. 4 is an enlarged side view of the main section of a guide groove in the keyboard musical instrument depicted in FIG. 3.

As depicted in FIG. 3 and FIG. 4, the guide groove 20 is a groove where the front guide shaft 23 of the front lid 16 and the rear guide shaft 24 of the rear lid 17 can be movably inserted, and is formed in a metal plate 20*a* embedded in the side plates 5. The guide groove 20 has a drooping portion that droops from above the front side of the keyboard section 10 toward the upper portion of the front plate 3, and is formed so as to be tilted diagonally upward from above the front side of the keyboard section 10 toward the upper side of the console panel 13 and then substantially horizontally continue toward the rear plate 4 of the musical instrument case 1.

Figure 5A:
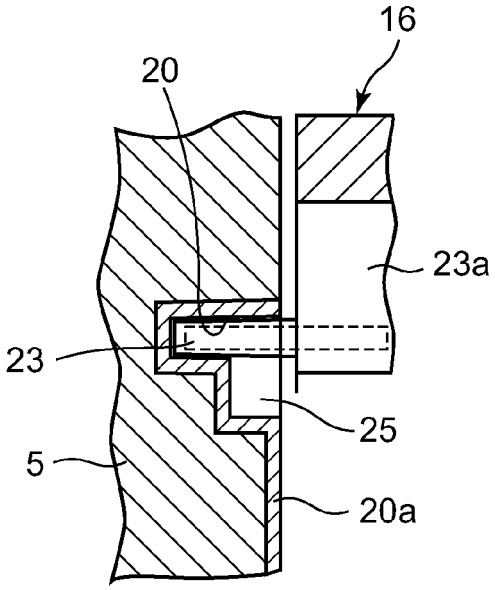
Figure 5B:
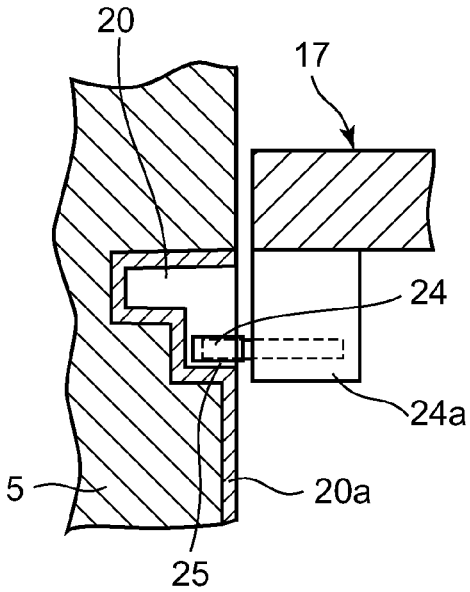

In this case, as depicted in FIG. 5A and FIG. 5B, the rear guide shaft 24 of the rear lid 17 is formed such that the projection length toward a side, that is, the projection length from each side surface of the rear lid 17 toward the inner surface of each side plate 5 is shorter than the projection length of the front guide shaft 23 of the front lid 16. For this reason, the guide groove 20 is formed such that the depth toward the side, that is, the depth in the thickness direction from the inner surface to the outer surface of each side plate 5 is substantially equal in depth to the projection length of the front guide shaft 23 of the front lid 16.

As depicted in FIG. 1, a guide recess 25, in which the rear guide shaft 24 of the rear lid 17 comes in as depicted in FIG. 4, FIG. 5A, and FIG. 58 when the keyboard lid 14 covers and closes the keyboard section 10, is provided at the intermediate portion of the tilted portion of the guide groove 20. The recess amount of the guide recess 25 is determined by a drooping movement amount of the rear lid 17 that occurs when the front lid 16 makes a drooping movement over the drooping portion.

As depicted in FIG. 1, FIG. 4, FIG. 5A, and FIG. 5B, the guide recess 25 is formed such that the depth toward the side, that is, the length in the thickness direction from the inner surface toward the outer surface of the side plate 5 is substantially equal in depth to the projection length of the rear guide shaft 24 of the rear lid 17 and shallower than the guide groove 20.

When the front guide shaft 23 of the front lid 16 makes a drooping movement over the drooping portion, the rear guide shaft 24 of the rear lid also makes a drooping movement by the recess amount of the recess. By the depth of the guide recess 25 (the drooping movement amount) being set as described above, the upper surface of the front lid 16 and the upper surface of the rear lid 17 can be on a same plane as depicted in FIG. 1.

That is, as depicted in FIG. 1 and FIG. 5B, the guide recess 25 is structured so that, when the front lid 16 and the rear lid 17 cover and close the keyboard section 10, the rear guide shaft 24 of the rear lid 17 comes in the guide recess 25, whereby the front lid 16 and the rear lid 17 are positioned on the same plane to form a substantially flat shape as a whole, in a state of being tilted forward and downward.

Figure 6:
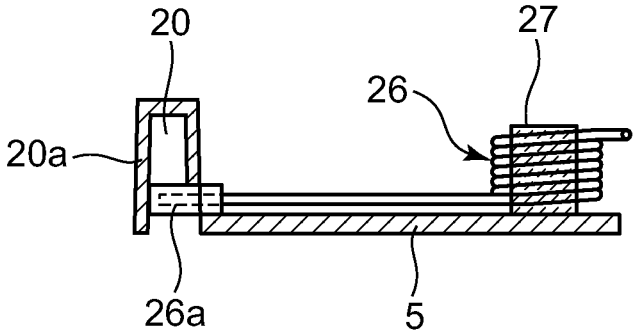
FIG. 6 is an enlarged plan view of a pressing member that presses the front lid in an opening direction in the keyboard musical instrument depicted in FIG. 3.

As depicted in FIG. 1, FIG. 3, and FIG. 6, a pressing member 26 is provided at the front in the musical instrument case 1. When the front lid 16 and the rear lid 17 cover and close the keyboard section 10, the pressing member 26 resiliently presses the front guide shaft 23 of the front lid 16 in a pushing-up direction. The pressing member 26 is a torsion spring, and its coil portion is mounted on a mount shaft 27 provided on the side surfaces 5 of the musical instrument case 1.

That is, as depicted in FIG. 3 and FIG. 6, the pressing member 26 is structured so that one end of the coil portion mounted on the mount shaft 27 is fixed to the side plates 5 and a tip end 26*a*, which is the other end thereof, extends toward the upper portion of the front plate 3. As a result, the pressing member 26 is structured so that its tip end 26*a* makes elastic contact with the front guide shaft 23 from below, thereby resiliently pushing up the front guide shaft 23 and pressing the front lid 16 in an opening direction.

Meanwhile, as depicted in FIG. 1 to FIG. 3, the guide mechanism section 21 is structured so as to guide, in a vertical direction, the rear end of the rear lid 17 moving by being folded at the coupling section 18 with respect to the front lid 16 when the keyboard lid 14 is opened or closed. In this case, a coupling member 22 is provided at the rear end of the rear lid 17. The coupling member 22 includes a mount plate 28*a* provided at the rear end of the rear lid 17 and a mount shaft 28*b* rotatably mounted on the mount plate 28*a*.

As depicted in FIG. 1 to FIG. 3, the guide mechanism section 21 includes a support shaft 30 mounted with a fixing section 29 on the inner surface of one side plate 5 positioned near the upper portion of the rear end of the keyboard section 10, an arm section 31 having one end rotatably mounted on the support shaft 30 and the other end mounted on the mount shaft 28*b* of the coupling member 22, a rotating shaft 34 mounted on the arm section 31, a pinion gear 32 rotatably mounted on the rotating shaft 34, and an arc-shaped rack gear 35 that engages with the pinion gear 32 for movement.

In this case, as depicted in FIG. 2, a metal plate 38 is embedded in the side plate 5 of the musical instrument case 1 via a reinforcing plate 33. As depicted in FIG. 1 to FIG. 3, the rotating shaft 34 projects toward the inner surface of the side plate 5, with its projecting tip being inserted in an arc groove 37 formed in the metal plate 38 for guide. The arc groove 37 is formed in a semiarc shape centering on the support shaft 30. As with the arc groove 37, the rack gear 35 is formed in a semiarc shape in the metal plate 38, centering on the support shaft 30 and having a radius shorter than the radius of the arc groove 37.

With this, as depicted in FIG. 1, the guide mechanism section 21 is structured so that, with the keyboard lid 14 covering and closing the keyboard section 10, the pinion gear 32 is positioned so as to be engaged with the upper end of the rack gear 35, and the rotating shaft 34 is positioned at the upper end of the arc groove 37, whereby the rear end of the rear lid 17 pushed up via the coupling member 22, the rear guide shaft 24 of the rear lid 17 comes in the guide recess 25 of the guide groove 20, and the front lid 16 and the rear lid 17 are placed on a same continuous plane.

As depicted in FIG. 3, the guide mechanism section 21 is structured so that, when the keyboard lid 14 is moved toward the rear side of the musical instrument case 1 to expose the keyboard section 10 upward, the pinion gear 32 is engaged with the rack gear 35 to move from an upper end to a rear end. Also, the rotating shaft 34 moves from the upper end to the rear end along the arc groove 37, as the rear lid 17 gradually bends at the coupling section 18 with respect to the front lid 16, whereby the rear end of the rear lid 17 and the coupling member 22 move to the lower portion of the rear end of the keyboard chassis 11, the rear guide shaft 24 of the rear lid 17 moves to the rear end of the guide groove 20, and the rear lid 17 is positioned at a substantially right angle with respect to the front lid 16.

On the other hand, as depicted in FIG. 1 to FIG. 3, the guide mechanism section 21 includes a braking member 36 that brakes the movement of the rear end of the rear lid 17 in a vertical direction when the keyboard lid 14 is opened or closed. The braking member 36 is a torsion coil spring whose coil portion is placed around the outer perimeter of the support shaft 30. The coil portion has one end mounted on the arm section 31 and the other end mounted on the fixing section 29 provided on the side plate 5 to fix the support shaft 30.

As a result, the braking member 36 is structured to enter a neutral state where load is hardly given to the arm section 31 when the arm section 31 rotates around the support shaft 30 to be positioned in a substantially horizontal direction. When the arm section 31 moves upward more than the neutral state, the braking member 36 gives a load to the arm section 31 in a direction in which the rear lid 17 is opened. When the arm section 31 moves downward more than the neutral state, the braking member 36 gives a load to the arm section 31 in a direction in which the rear lid 17 is closed.

That is, the braking member 36 is structured so that the load in the direction of pushing down the arm section 31 gradually increases to gradually increase the moving force in the direction of closing the rear lid 17 when the arm section 31 rotates around the support shaft 30 to move upward more than the neutral state. In addition, the load in the direction of pushing down the arm section 31 becomes maximum to increase the moving force in the direction of closing the rear lid 17 to maximum when the tip of the arm section 31 moves to the uppermost side as depicted in FIG. 1.

Also, the braking member 36 is structured so that the load in the direction of pushing up the arm section 31 gradually increases to gradually increase the moving force in the direction of opening the rear lid 17 when the arm section 31 rotates around the support shaft 30 to move downward more than the neutral state. In addition, the load in the direction of pushing up the arm section 31 becomes maximum to increase the moving force in the direction of opening the rear lid 17 to maximum when the tip of the arm section 31 moves to the lowermost side as depicted in FIG. 3.

Next, the operation of the open and close device 15 of the keyboard lid 14 in the keyboard musical instrument is described.

When opening the keyboard lid 14 to expose the keyboard section 10 upward, the user moves the keyboard lid 14 toward the rear of the musical instrument case 1 while lifting up the front end of the front lid 16 of the keyboard lid 14. Here, the front guide shaft 23 of the front lid 16 is resiliently pushed up hardest by the pressing force of the pressing member 26, and the highest load in the direction of pushing down the arm section 31 is given by the braking member 36. Therefore, the keyboard lid 14 starts moving with a light force toward the rear side of the musical instrument case 1.

Figure 7:
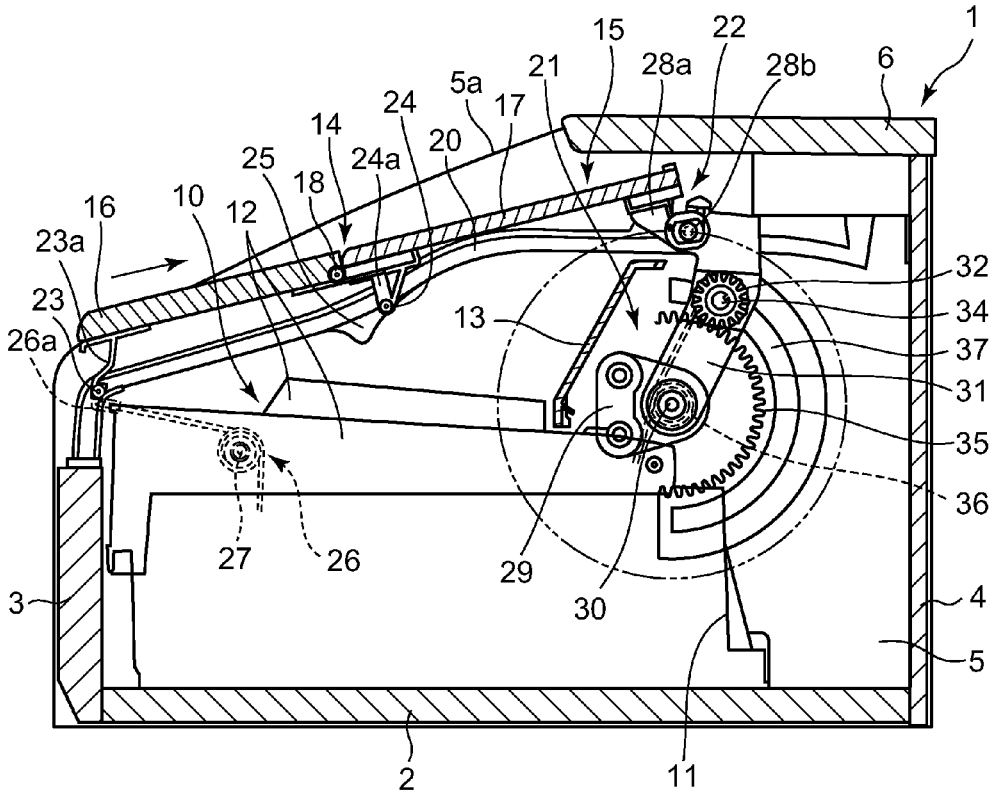
FIG. 7 is a sectional view showing a state where the keyboard lid of the keyboard musical instrument depicted in FIG. 1 has started to open.

As such, when the keyboard lid 14 starts moving toward the rear side of the musical instrument case 1, the front guide shaft 23 of the front lid 16 moves from the front end toward the rear side along the guide groove 20, and the rear guide shaft 24 of the rear lid 17 moves from the inside of the guide recess 25 of the guide groove 20 toward the inside of the guide groove 20, as depicted in FIG. 7. As such, when the front guide shaft 23 of the front lid 16 moves along the guide groove 20, the pressing force of the pressing member 26 with respect to the front guide shaft 23 of the front lid 16 is gradually decreased.

In addition, the pinion gear 32 of the rear lid 17 is engaged with the rack gear 35 to move downward from the front end, and the rotating shaft 34 moves downward from the upper end along the arc groove 37, as depicted in FIG. 7. With the movement of the pinion gear 32 and the rotating shaft 34, the arm section 31 rotates about the support shaft 30 in the clockwise direction. For this reason, as depicted in FIG. 7, the load of the braking member 36 in the direction of pushing down the arm section 31 is gradually decreased. With this, the moving force to move the keyboard lid 14 in the opening direction is gradually increased.

Then, when the keyboard lid 14 further moves toward the rear side of the musical instrument case 1, as the front lid 16 and the rear lid 17 bend at the coupling section 18, the front lid 16 moves diagonally upward along the guide groove 20 and the rear lid 17 moves diagonally downward as being tilted downward at the rear. Then, when the front guide shaft 23 of the front lid 16 reaches near the intermediate portion of the guide groove 20, since the front guide shaft 23 of the front lid 16 is longer than the rear guide shaft 24 of the rear lid 17 as depicted in FIG. 5A, the front guide shaft 23 moves in the guide groove 20 without coming in the guide recess 25 of the guide groove 20.

Figure 8:
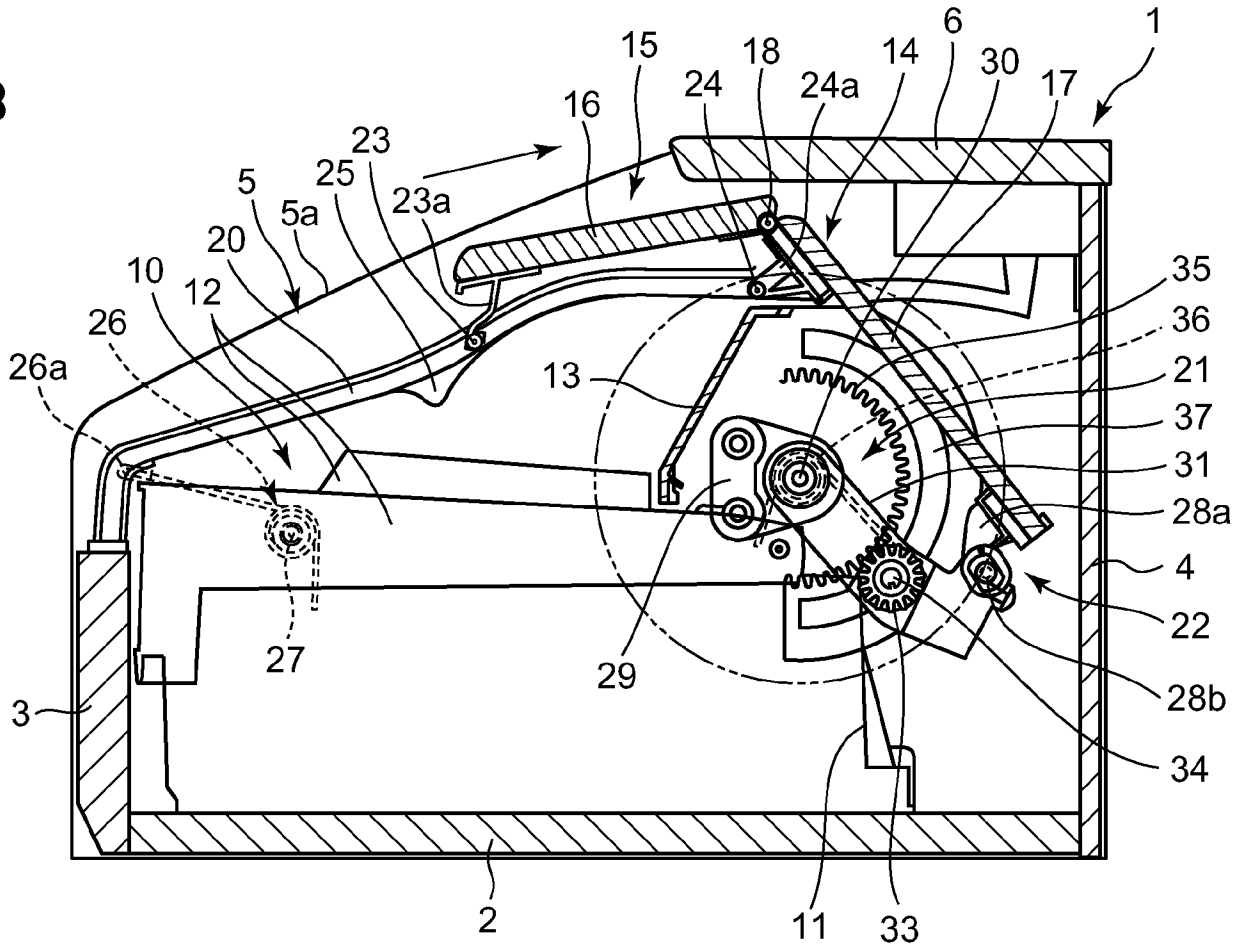
FIG. 8 is a sectional view showing a state where the keyboard lid of the keyboard musical instrument depicted in FIG. 7 has been folded to move to the rear portion of the musical instrument case.

In addition, as depicted in FIG. 8, the rear guide shaft 24 of the rear lid 17 moves toward the rear side along the guide groove 20 and the pinion gear 32 of the rear lid 17 is engaged with the rack gear 35 to move to a position near the intermediate portion in the vertical direction. Along with this, the rotating shaft 34 moves to a position near the intermediate portion in the vertical direction along the arc groove 37. Here, the arm section 31 is also positioned near the intermediate portion in the vertical direction to enter a substantially horizontal state. As a result, the braking member 36 enters the neutral state where load is hardly given to the arm section 31.

In this state, when the keyboard lid 14 further moves toward the rear side of the musical instrument case 1, as depicted in FIG. 8, as the front lid 16 and the rear lid 17 bend at the coupling section 18 at a substantially right angle, the front lid 16 moves below the top plate 6, and the front guide shaft 23 of the front lid 16 moves to a position in the guide groove 20 corresponding to the front end of the top plate 6. Also, the rear lid 17 moves so as to diagonally droop toward the rear plate 4, and the rear guide shaft 24 of the rear lid 17 moves to the rear end of the guide groove 20.

Here, as depicted in FIG. 3, the pinion gear 32 of the guide mechanism section 21 is engaged with the rack gear 35 to move to the lower end, and the rotating shaft 34 moves to the lower end along the arc groove 37. Accordingly, the rear end of the rear lid 17 and the coupling member 22 move toward the lower rear end of the keyboard chassis 11. With this, the arm section 31 moves from the position near the intermediate portion in the vertical direction toward the lower side.

As a result, when the braking member 36 passes the neutral state to gradually increase the load to be given in the direction of pushing up the arm section 31 and the tip of the arm section 31 reaches the lower end, the load of the braking member 36 to push up the arm section 31 becomes maximum. This can prevent the rear lid 17 from abruptly falling down, thereby braking an abrupt opening operation of the keyboard lid 14 to open the keyboard lid 14 safely.

On the other hand, when closing the keyboard lid 14 to cover the keyboard section 10, the user first draws the front end of the front lid 16 of the keyboard lid 14 toward the front side of the musical instrument case 1, as depicted in FIG. 3. Here, since the rear end of the rear lid 17 is pushed up by the braking member 36 via the coupling member 22, the keyboard lid 14 can be moved with a light force toward the front side of the musical instrument case 1. That is, since the load by the braking member 36 to push up the arm section 31 is at maximum, the rear lid 17 is moved by a force lighter than its own weight, by the pushing-up force of the arm section 31 by the braking member 36.

As such, when the keyboard lid 14 moves toward the front side of the musical instrument case 1, as the front lid 16 and the rear lid 17 gradually bend at the coupling section 18, the front guide shaft 23 of the front lid 16 moves toward the front side of the musical instrument case 1 along the guide groove 20, as depicted in FIG. 8. Also, as the rear lid 17 is moving diagonally upward along the rear plate 4, the rear guide shaft 24 of the rear lid 17 moves toward the front side of the musical instrument case 1 along the guide groove 20.

Here, as depicted in FIG. 8, the pinion gear 32 of the guide mechanism section 21 is engaged with the rack gear 35 to move upward from the lower end, and the rotating shaft 34 moves upward from the lower end along the arc groove 37. Accordingly, the coupling member 22 pushes up the rear end of the rear lid 17. With this, the arm section 31 rotates in the counterclockwise direction, and the braking member 36 proceeds toward the neutral state, and the load of pushing up the arm section 31 is gradually decreased. As a result, the moving force of moving the keyboard lid 14 in a closing direction is gradually increased.

As such, when the keyboard lid 14 moves toward the front side of the musical instrument case 1 to cause the front guide shaft 23 of the front lid 16 to move to a position near the intermediate portion of the guide groove 20, the front lid 16 and the rear lid 17 bend at the coupling section 18 toward directions to be further spread apart, the rear guide shaft 24 of the rear lid 17 moves toward the front side of the musical instrument case 1 along the guide groove 20, and the rear lid 17 is drawn obliquely upward toward the top plate 6, as depicted in FIG. 8.

Here, as depicted in FIG. 8, the pinion gear 32 of the guide mechanism section 21 is engaged with the rack gear 35 to move from the lower side to a position near the intermediate portion, and the rotating shaft 34 moves from the lower side to a position near the intermediate portion along the arc groove 37. Accordingly, the coupling member 22 further pushes up the rear end of the rear lid 17. With this, the arm section 31 further rotates in the counterclockwise direction, and the braking member 36 enters the neutral state where load is hardly given to the arm section 31.

Then, when the keyboard lid 14 further moves toward the front side of the musical instrument case 1, the front guide shaft 23 of the front lid 16 moves toward the front side of the musical instrument case 1 along the guide groove 20 and, even when the front guide shaft 23 reaches the guide recess 25 of the guide groove 20, the front guide shaft 23 passes above the guide recess 25 along the guide groove 20 without coming in the guide recess 25, as depicted in FIG. 5A. Here, the front lid 16 and the rear lid 17 bend at the coupling section 18 toward directions to be further spread apart, the rear guide shaft 24 of the rear lid 17 moves along the guide groove 20 to approach the guide recess 25, and the rear lid 17 is drawn up so as to be in a state substantially parallel to the top plate 6.

Here, the pinion gear 32 of the guide mechanism section 21 is engaged with the rack gear 35 to move from the position near the intermediate portion toward the front side, and the rotating shaft 34 moves from the position near the intermediate portion toward the front side along the arc groove 37. Accordingly, the coupling member 22 moves upward to further push up the rear end of the rear lid 17. With this, the arm section 31 further rotates in the counterclockwise direction, and the braking member 36 passes the neutral state to gradually increase the load to be given in the direction of pushing down the arm section 31.

Then, when the keyboard lid 14 further moves toward the front side of the musical instrument case 1 and the front guide shaft 23 of the front lid 16 moves along the guide groove 20 to approach the front plate 3 as depicted in FIG. 7, a pressing force by the pressing member 26 is given to the front guide shaft 23. By this pressing force of the pressing member 26, the moving force of the keyboard lid 14 is gradually increased. Here, the rear guide shaft 24 of the rear lid 17 starts coming in the guide recess 25 of the guide groove 20, whereby the front lid 16 and the rear lid 17 are placed on a substantially same plane in a state of being tilted forward and downward.

In this state, when the keyboard lid 14 further moves toward the front side of the musical instrument case 1 and the front guide shaft 23 of the front lid 16 moves to the front end of the guide groove 20 to abut on the front plate 3 as depicted in FIG. 1, the pressing force of the pressing member 26 to the front guide shaft 23 reaches maximum, whereby the front lid 16 is slowly closed. Therefore, the keyboard lid 14 can be safely closed, preventing a hand or finger from being pinched by the keyboard lid 14. Here, as depicted in FIG. 5B, the rear guide shaft 24 of the rear lid 17 comes in the guide recess 25 of the guide groove 20, and the front lid 16 and the rear lid 17 become a flat plate shape in a state of being tilted forward and downward, and are placed on the same plane.

Here, as depicted in FIG. 1, the pinion gear 32 of the guide mechanism section 21 is engaged with the rack gear 35 to move to the upper end, and the rotating shaft 34 moves to the upper end along the arc groove 37. Accordingly, the coupling member 22 moves upward to push up the rear end of the rear lid 17 to the highest. With this, the arm section 31 rotates about the support shaft 30 in the counterclockwise direction to stand substantially upright, and the load to be given by the braking member 36 to push down the arm section 31 reaches maximum.

As a result, the rotation of the arm section 31 rotating about the support shaft 30 is increased to maximum. This also prevents the rear lid 17 from abruptly moving toward the closing direction, and brakes an abrupt closing operation of the keyboard lid 14. As such, by the pressing force of the pressing member 26 and the braking force of the braking member 36, the keyboard lid 14 can be safely closed, preventing the keyboard lid 14 from being abruptly closed and pinching a hand or finger.

As such, this open and close device 15 of the keyboard lid 14 in the keyboard musical instrument includes the front guide shaft 23 that is provided on the front of the front lid 16 and projects toward sides of the front lid 16, the rear guide shaft 24 that is provided on the front of the rear lid 17 and projects toward sides of the rear lid 17, and the guide groove 20 that guides the front guide shaft 23 and the rear guide shaft 24 in the front and back directions of the musical instrument case 1. The guide groove 20 is provided with the guide recess 25 where the rear guide shaft 24 comes in so that the front lid 16 and the rear lid 17 are placed on the same plane when the front lid 16 and the rear lid 17 are closed and cover the keyboard section 10. Thus, the keyboard lid 14 can be stably and smoothly opened or closed with a simple structure.

That is, in this open and close device 15 of the keyboard lid 14, the front guide shaft 23 of the front lid 16 and the rear guide shaft 24 of the rear lid 17 are smoothly guided by the guide groove 20 when the keyboard lid 14 is opened or closed. In addition, when the keyboard lid 14 is closed and covers the keyboard section 10, the rear guide shaft 24 comes in the guide recess 25 of the guide groove 20. Therefore, the front lid 16 and the rear lid 17 can be placed on the same plane without the rear portion of the front lid 16 and the front portion of the rear lid 17 being lifted. As a result, the keyboard lid 14 can be stably and smoothly opened or closed with a simple structure without requiring a special component such as a displacement mount section.

In this case, the rear guide shaft 24 is formed such that the projection length toward each side of the rear lid 17 is shorter than the projection length of the front guide shaft 23, and the guide groove 20 is formed such that the depth toward the side in the axial direction of the front guide shaft 23 is substantially equal in depth to the projection length of the front guide shaft 23. The guide recess 25 is formed such that the depth toward the side in the axial direction of the rear guide shaft 24 is substantially equal in depth to the projection length of the rear guide shaft 24. Thus, when the keyboard lid 14 is opened or closed, the front guide shaft 23 and the rear guide shaft 24 can be smoothly guided by the guide groove 20. Also, when the keyboard lid 14 is closed and covers the keyboard section 10, the rear guide shaft 24 of the rear lid 17 reliably comes in the guide recess 25. As a result, the front lid 16 and the rear lid 17 can be placed on the same plane in a good condition with a simple structure.

Also, the front lid 16 of the keyboard lid 14 is formed such that the length in the front to rear direction of the musical instrument case 1 is shorter than the length in the front and rear direction of the rear lid 17. Therefore, the length in the front to rear direction of the top plate 6 of the musical instrument case 1 positioned above the front lid 16 is short when the keyboard lid 14 is opened to expose the keyboard section 10 upward. In addition, the rear lid 17 is placed along the rear plate 4 of the musical instrument case 1 with it being positioned at a substantially right angle with respect to the front lid 16. Therefore, the musical instrument case 1 can be structured to be compact as a whole.

That is, by the front lid 16 being shorter than the rear lid 17, the length of the musical instrument case 1 in the front to rear direction can be shortened, and the rear lid 17 can be positioned at a substantially right angle with respect to the front lid 16 to approach the rear portion of the keyboard section 10. Therefore, even though the length of the rear lid 17 in the front to rear direction is longer than the length of the front lid 16 in the front to rear direction, the length of the musical instrument case 1 in the front to rear direction can be shortened. As a result, the musical instrument case 1 can be structured to be compact as a whole.

Moreover, the open and close device 15 of the keyboard lid 14 includes the pressing member 26 that resiliently presses the front guide shaft 23 toward the direction of opening the front lid 16 when the front lid 16 and the rear lid 17 cover and close the keyboard section 10. Thus, when the keyboard lid 14 is opened by lifting the front end of the front lid 16, the keyboard lid 14 can be opened by a light force because of the pressing force of the pressing member 26. Also, when the keyboard lid 14 is closed, the pressing force of the pressing member 26 presses the front lid 16 in the direction of opening, thereby allowing the movement in the direction of closing the keyboard lid 14 to be delayed. As a result, the keyboard lid 14 can be safely opened or closed, so that a finger or hand of an instrument player is prevented from being pinched and injured.

Furthermore, the open and close device 15 of the keyboard lid 14 includes the guide mechanism section 21 that guides the rear end of the rear lid 17 in the vertical direction when the keyboard lid 14 is opened or closed. As a result, when the keyboard lid 14 is opened, the rear end of the rear lid 17 can be favorably and smoothly guided by the guide mechanism section 21 from the upper end toward the lower end. When the keyboard lid 14 is closed, the rear end of the rear lid 17 can be favorably and smoothly guided by the guide mechanism section 21 from the lower end toward the upper end.

In this case, the guide mechanism section 21 includes the support shaft 30 provided on the inner surface of the side plate 5 of the musical instrument case 1, the arm section 31 having one end rotatably mounted on the support shaft 30 and the other end mounted on the rear end of the rear lid 17 via the coupling member 22, the rotating shaft 34 mounted on the arm section 31, the pinion gear 32 rotatably mounted on the rotating shaft 34, and the arc-shaped rack gear 35 that is engaged with the pinion gear 32 for movement. As a result, the rear end of the rear lid 17 can be favorably and reliably guided.

That is, in the guide mechanism section 21, when the keyboard lid 14 is opened or closed, the arm section 31 rotates about the support shaft 30, and the pinion gear 32 rotatably mounted on the arm section 31 via the rotating shaft 34 is engaged with the rack gear 35 to make a rotational movement. Therefore, the rear end of the rear lid 17 can be smoothly and reliably moved along a predetermined movement path. Also, the rear end of the rear lid 17 can be placed to be close to the lower portion of the lower end of the keyboard section 10. As a result, the rear end of the rear lid 17 can be favorably guided, and the keyboard lid 14 can be compactly housed in the musical instrument case 1.

Still further, the guide mechanism section 21 includes the braking member 36 that brakes the movement of the rear end of the rear lid 17 in the vertical direction when the keyboard lid 14 is opened or closed. Therefore, when the guide mechanism section 21 moves the rear end of the rear lid 17 along the predetermined movement path, the operation of the keyboard lid 14 can be favorably braked by the braking member 36. As a result, the keyboard lid 14 can be safely opened or closed.

In this case, the braking member 36 is a torsion coil spring whose coil portion is placed around the outer perimeter of the support shaft 30. The coil portion has one end mounted on the arm section 31 and the other end mounted on the fixing section 29 provided on the side plate 5. In this state, the braking member 36 enters the neutral state where load is hardly given to the arm section 31 when the arm section 31 rotates about the support shaft 30 to move in a substantially horizontal direction. Therefore, it is possible to favorably and smoothly open and close the keyboard lid 14 while braking the movement of the rear lid 17.

That is, with this braking member 36, when the keyboard lid 14 is closed and covers the keyboard section 10, the pinion gear 32 is engaged with the rack gear 35 to move from the lower end of the ark groove 37 toward a position near the intermediate portion. In addition, when the rotating shaft 34 moves from the lower end toward the position near the intermediate portion, the braking member 36 gives a load so as to push up the arm section 31. Therefore, the keyboard lid 14 can be moved by a light force.

In the braking member 36, when the keyboard lid 14 is closed and covers the keyboard section 10, the pinion gear 32 is engaged with the rack gear 35 to move from the position near the intermediate portion to the upper end. When the rotating shaft 34 moves from the position near the intermediate portion of the arc groove 37 to the upper end, the braking member 36 gives a load in the direction of pushing down the arm section 31. Thus, the closing operation of the keyboard lid 14 can be delayed and the keyboard lid 14 can be moved slowly. As a result, the keyboard lid 14 can be safely closed.

Also, in the braking member 36, when the keyboard lid 14 is opened to expose the keyboard section 10 upward, the pinion gear 32 is engaged with the rack gear 35 to move from the upper end toward the position near the intermediate portion, as the rear lid 17 gradually bends at the coupling section 18 with respect to the front lid 16. When the rotating shaft 34 moves from the upper end toward the position near the intermediate portion along the arc groove 37, the braking member 36 gives a load so as to push down the arm section 31. As a result, the keyboard lid 14 can be opened by a light force.

Furthermore, in the braking member 36, when the keyboard lid 14 is opened to expose the keyboard section 10 upward, the pinion gear 32 is engaged with the rack gear 35 to move from the position near the intermediate portion to the lower end, as the rear lid 17 gradually bends at the coupling section 18 with respect to the front lid 16. When the rotating shaft 34 moves from the position near the intermediate portion toward the lower end along the arc groove 37, the braking member 36 gives a load so as to push up the arm section 31. As a result, the closing operation of the keyboard lid 14 can be delayed to cause the keyboard lid 14 to move slowly. Accordingly, the keyboard lid 14 can be safely closed.

Also, since the guide mechanism section 21 is coupled to the rear end of the rear lid 17 via the coupling member 22, the length of the arm section 31 can be shortened to a minimum by the coupling member 22. As a result, the movement path of the rear end of the rear lid 17 can be made compact. That is, since the coupling member 22 is mounted on the rear end of the rear lid 17 to project toward the support shaft 30 of the arm section 31, the length from the rear end of the rear lid 17 to the support shaft 30 can be shortened by the projecting length of the coupling member 22.

Accordingly, with this guide mechanism section 21, by shortening the length of the arm section 31 by the coupling member 22, each radius of the arc-shaped rack gear 35 and the arc groove 37 can be decreased. Therefore, the guide mechanism section 21 can be structured to be compact, and the musical instrument case 1 can be made compact as a whole.

While the present invention has been described with reference to the preferred embodiments, it is intended that the invention be not limited by any of the details of the description therein but includes all the embodiments which fall within the scope of the appended claims.

What is claimed is:

1. A keyboard device comprising:

a keyboard section which is provided in a musical instrument case;

a keyboard lid which is foldable by a front lid and a rear lid being coupled together by a coupling section so as to cover the keyboard section;

a front guide shaft which is provided on front portion of the front lid and projects toward sides of the front lid;

a rear guide shaft which is provided on front portion of the rear lid and projects toward sides of the rear lid; and a guide groove which guides the front guide shaft and the rear guide shaft in front and back directions of the musical instrument case, and is provided with a guide recess where the rear guide shaft comes in so that the front lid and the rear lid are placed on a same plane when the front lid and the rear lid are closed and cover the keyboard section.

2. The keyboard device according to claim 1, wherein the guide groove has a drooping portion which droops from above front side of the keyboard section toward lower portion of the front side, and a recess amount of the guide recess is determined by a drooping movement amount of the rear guide shaft of the rear lid that occurs when the front guide shaft of the front lid makes a drooping movement over the drooping portion.

3. The keyboard device according to claim 1, wherein the rear guide shaft is formed such that a projection length toward a side is shorter than a projection length of the front guide shaft, the guide groove is formed such that a depth toward the side is substantially equal in depth to the projection length of the front guide shaft, and the guide recess is formed such that a depth toward the side is substantially equal in depth to the projection length of the rear guide shaft.

4. The keyboard device according to claim 1, wherein the front lid is formed such that a length in the front and back directions of the musical instrument case is shorter than a length of the rear lid in the front and back directions.

5. The keyboard device according to claim 1, further comprising:

a pressing member which presses the front guide shaft toward a direction in which the front lid is opened when the front lid and the rear lid are closed and cover the keyboard section.

6. The keyboard device according to claim 1, further comprising:

a guide mechanism section which guides rear end of the rear lid in a vertical direction when the keyboard lid is opened or closed.

7. The keyboard device according to claim 1, further comprising:

a braking member which brakes a movement of rear end of the rear lid in a vertical direction when the keyboard lid is opened or closed.

* * * * *